US007420134B1

(12) United States Patent
Leary et al.

(10) Patent No.: US 7,420,134 B1
(45) Date of Patent: Sep. 2, 2008

(54) FLUID LEVEL SWITCH

(75) Inventors: Kevin J. Leary, Hamilton, MA (US); Frank Mark Domzalski, Wellesley, MA (US)

(73) Assignee: ITT Manufacturing Enterprises, Inc, Wilmington, DE (US)

( * ) Notice: Subject to any disclaimer, the term of this patent is extended or adjusted under 35 U.S.C. 154(b) by 0 days.

(21) Appl. No.: 11/725,185

(22) Filed: Mar. 15, 2007

(51) Int. Cl.
*H01H 35/18* (2006.01)

(52) U.S. Cl. ..... 200/84 R; 200/61.21

(58) Field of Classification Search ..... 200/61.2, 200/61.21, 84 R–84 C; 73/305–309, 313, 73/317, 318, 322.5; 340/604, 605, 623, 625
See application file for complete search history.

(56) References Cited

U.S. PATENT DOCUMENTS 2,748,220 A * 5/1956 Lung ..... 200/84 R
2,826,919 A * 3/1958 Klingler ..... 74/18.1
2,878,335 A * 3/1959 Vitu ..... 200/84 R
2,885,507 A 5/1959 Holman
3,621,168 A 11/1971 Durand
3,686,451 A * 8/1972 Pottharst, Jr. ..... 200/84 R
3,829,105 A * 8/1974 Kammeraad ..... 277/502
3,890,478 A 6/1975 Riddel
3,908,107 A 9/1975 Danne et al.
4,074,097 A * 2/1978 Hutchinson et al. ..... 200/81.9 R
4,084,073 A 4/1978 Keener
4,095,064 A * 6/1978 Fleckenstein ..... 200/61.21
4,147,906 A * 4/1979 Levine ..... 200/61.2
4,600,820 A 7/1986 Bruder et al.
4,746,776 A 5/1988 Komaniak
4,848,151 A 7/1989 Bruder et al.
5,374,790 A 12/1994 Horvath
5,426,271 A * 6/1995 Clark et al. ..... 200/84 C
5,493,086 A * 2/1996 Murphy et al. ..... 200/84 R
5,814,780 A * 9/1998 Batchelder et al. ..... 200/84 R
5,827,962 A * 10/1998 Guenther et al. ..... 73/308
6,254,351 B1 7/2001 Culp
6,380,499 B1 * 4/2002 Edwards ..... 200/84 C
6,729,847 B2 5/2004 Rossman

* cited by examiner

*Primary Examiner*—Michael A Friedhofer

(57) ABSTRACT

The present invention provides a float level switch featuring a housing; an actuator shaft arranged in the housing; and a low force shaft seal assembly arranged between the actuator shaft and the housing, having a combination of disks or seals, one being made of a semi-rigid lubricious material, for maintaining a watertight seal with a substantially reduced rotational force or friction on the actuator shaft than a conventional O-ring.

6 Claims, 3 Drawing Sheets

Fluid Level Switch

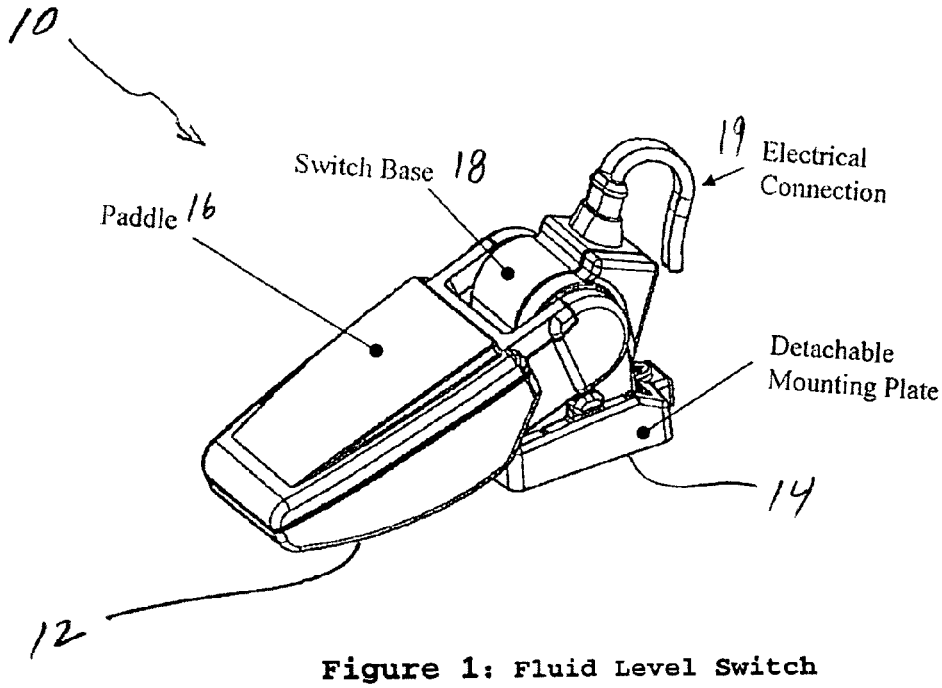
Figure 1: Fluid Level Switch
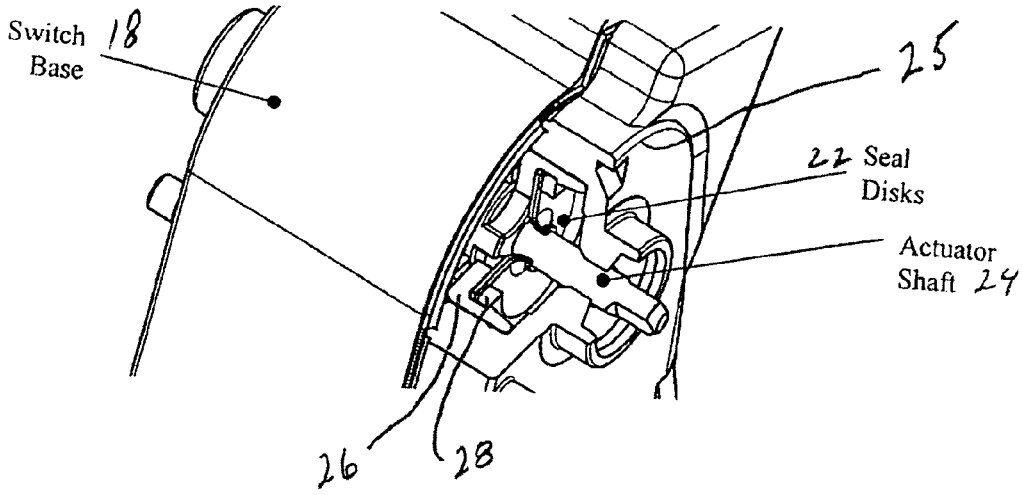
Figure 2: Low-Force Shaft Seal Arranged in Switch Base

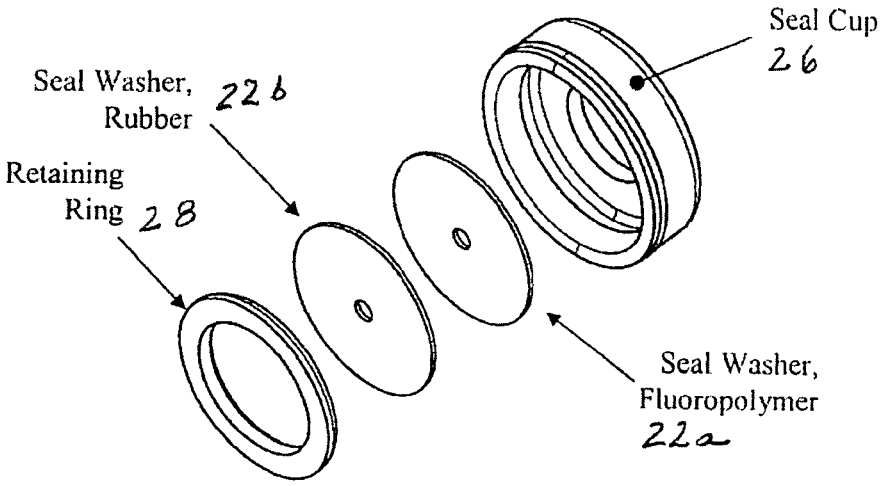
Figure 3: Exploded View of Low-Force Shaft Seal
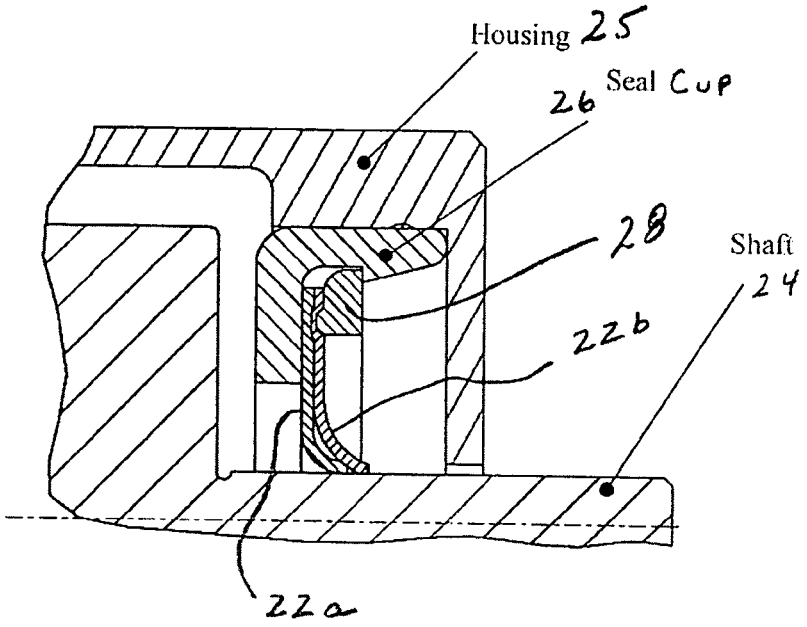
Figure 4: Cross-section of Low-Force Shaft Seal

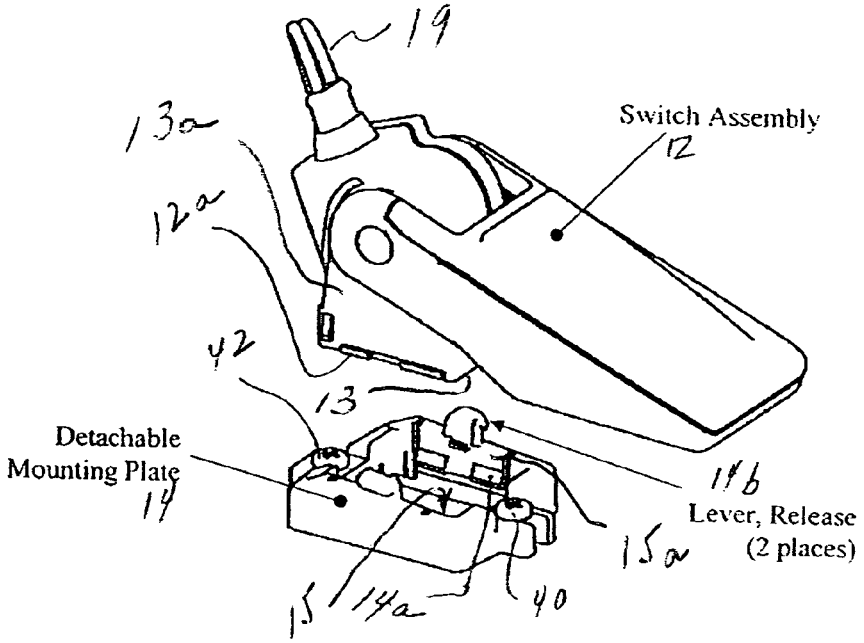
Figure 5: Switch Assembly Detached from Mounting Plate
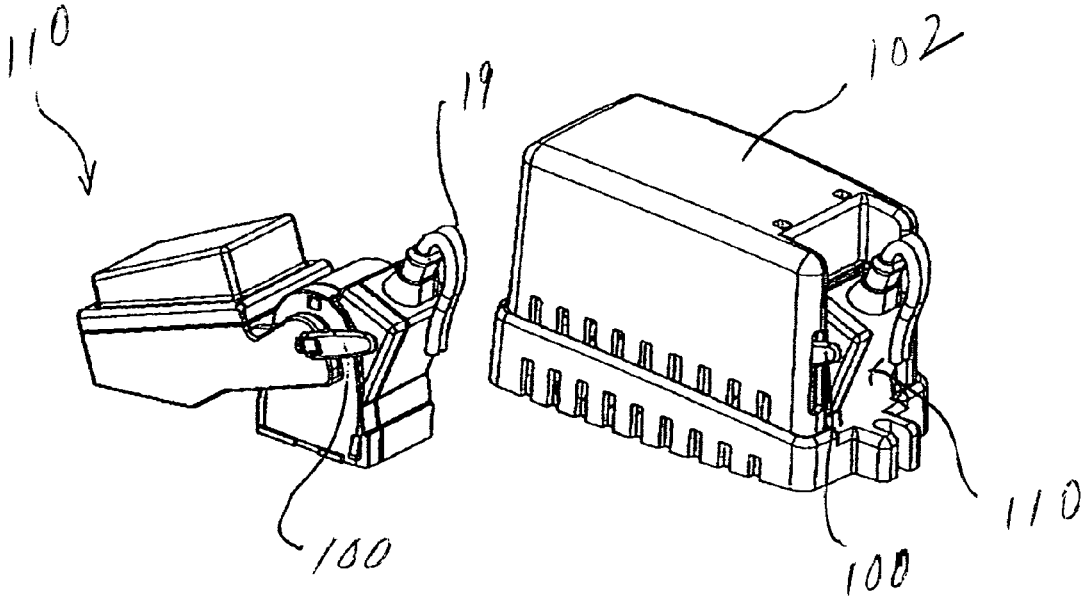
Figure 6: Cantilevered Test Lever

FLUID LEVEL SWITCH

BACKGROUND OF THE INVENTION

1. Field of the Invention

The present invention relates to a switch; and more particularly to a fluid level switch to sense changes in liquid levels.

2. Brief Description of Related Art

Paddle-type fluid level switches have historically used Mercury tubes to sense changes in liquid level and to provide the switch in an electrical circuit. Recent concerns about the health and environment impacts of Mercury have required a change in paddle switch technology.

One known float switch utilizes a snap switch having O-rings for the shaft seal. O-ring shaft seals, however, can impart high friction forces to the rotating shaft, which reduces the amount of buoyant force available to actuate the snap switch, and gravitational force available to reset the switch. These friction losses make the product less robust.

Moreover, a search was conducted in the United States Patent and Trademark Office and the following patents were developed by the searcher includes the following with a brief description thereof:

Different Float Structures

U.S. Pat. Nos. 3,621,168, 4,600,820, 4,848,151 and 5,814,780 show different float structures and are summarized as follows: The '168 patent discloses a switching device that uses electrical leads as a flexible member to eliminate the need for a hinge between a float 24 and a fixed structure. The '820 and '151 patents disclose an electrical cut off float switch having a balance float assembly with a counterweight and a solid float member pivoted on a pivot point. The '780 patent discloses a pivotable float switch inside a housing having a float with a float body and pivot arms coupled in pivot apertures in the housing.

Different Sealed Switches

U.S. Pat. Nos. 2,885,507, 3,890,478, 3,908,107 and 5,374,790 show different sealed switches and are summarized as follows: The '507 patent discloses a level indicator having a float supported on a pivot coupled to a switch actuator rod coupled via a pivot to a compartment. The '478 patent discloses a liquid level sensor having a float with an arm pivoted by a pin to a diaphragm, as well as a float having an arm coupled via retainers to a diaphragm. The '107 patent discloses a device for the control of a liquid level in a receptacle having a float mounted on a level arm and urged and pivoted on a bearing inside a refill container. The '790 patent discloses a liquid level switch assembly having a float mounted on a float arm rotatably mounted a pivot axle.

Other Switches

U.S. Pat. Nos. 4,084,073, 4,746,776 6,254,351, 6,729,847 show other types of switches and are summarized as follows: The '073 patent discloses a float-type pump control switch for a submersible pump, having an activator arm pivotally mounted within a housing that floats up and down based on the level of the fluid in the sump and turn on and off based on the angle of the float. The '776 patent discloses a float-actuated switching assembly having a float mounted on a movable cam that passes though a mounting member via an aperture and fitting. The '351 patent discloses a snap-action float assembly having a float assembly that rotates on a pivot axis inside a fluid reservoir. The '847 patent discloses a bilge pump seal and float actuator having a float coupled to an actuator that extends through an aperture of an interior wall, and having a seal and a sealing disk located within the aperture thereby sealing the same.

SUMMARY OF THE INVENTION

In its broadest sense, the present invention features a new and unique float level switch featuring a housing; an actuator shaft arranged in the housing; and a low force shaft seal assembly arranged between the actuator shaft and the housing, having a combination of disks or seals, one of the disks or seals being made of a semi-rigid lubricious material, for maintaining a watertight seal with a substantially reduced rotational force or friction on the actuator shaft than a conventional O-ring.

In a preferred embodiment, the low force shaft seal assembly may include a seal cup coupled in relation to the housing; an inboard disk or seal arranged between the seal cup and the actuator shaft and being made of the semi-rigid lubricious material; an outboard disk or seal coupled between the inboard disk or seal and the actuator shaft and being made of rubber; and a retaining ring arranged between the outboard disk or seal and the seal cup for frictionally engaging the outboard disk or seal and holding it in place.

The inboard disk or seal made of a fluoropolymer (i.e. Teflon) or other suitable semi-rigid lubricious material slides easily on the shaft and acts to present only a single edge of the second outboard (rubber) disk or seal to the rotating shaft surface.

The actuator shaft may be coupled to a buoyant paddle that is allowed to raise and lower by pivoting about an actuator axis; or rotational motion of the actuator shaft may actuate a snap switch located inside a switch base of the float level switch; or the float level switch may include a cover arranged thereon for protecting the buoyant paddle, and a cantilevered test lever may be coupled to the buoyant paddle for testing the float level switch when the cover is arranged thereon; or some combination of the aforementioned features.

In an alternative part of the disclosure, the float level switch may include a switch assembly having one or more projections; and a detachable mounting plate having one or more corresponding projections for receiving the projections of the switch assembly for frictionally engaging and detachably coupling the switch assembly to the detachable mounting plate so as to be able to detach the switch assembly from the detachable mounting plate by applying a suitable force to the switch assembly. The mounting plate may have one or more release levers.

In summary, the present invention provides a new paddle switch that incorporates the following novel features:

1) A low force seal—The shaft seal uses two washers, one made of Buna Rubber and the other of Teflon. The resulting arrangement results in a watertight seal with the low shaft friction than conventional O-Rings 2) A Detachable Mounting Plate—Although bilge pumps commonly come with detachable mounting bases; bilge switches with detachable mounting plates are previously unknown.

3) A cantilevered test switch—One switch embodiment includes a cover for protecting the switch paddle. The cover makes testing the switch difficult. Existing art involves a knob sticking out the side of the housing. An improved configuration disclosed herein uses a cantilevered test lever.

BRIEF DESCRIPTION OF THE DRAWING

FIG. 1 is a diagram of a fluid level switch according to the present invention.

FIG. 2 shows a low-force shaft seal in a switch base of the fluid level switch shown in FIG. 1.

FIG. 3 shows an exploded view of the low-force shaft seal shown in FIG. 2.

FIG. 4 shows an exploded view of the low-force shaft seal shown in FIG. 2.

FIG. 5 shows a switch assembly detached from the mounting plate consistent with that shown in FIG. 1.

FIG. 6 shows a cantilevered test lever according to the present invention.

DETAILED DESCRIPTION OF THE INVENTION

FIG. 1 shows an embodiment of a fluid level switch generally indicated as 10 having a switch assembly 12 detachably mounted on a mounting plate 14. The switch assembly 12 has a paddle 16 that is buoyant and is allowed to raise and lower by pivoting about an actuation axis. The rotational motion turns a shaft which actuates a snap switch located inside a switch base 18 and sends an electrical signal via an electrical connection 19.

FIG. 2 shows a low-force shaft seal according to the present invention shown in the form of seal disks generally indicated as 22 in relation to an actuator shaft 24 inside a housing 25 of the switch base 18. The low-force shaft seal is arranged in relation to, or may be understood to include, a seal cup 26 and a retaining ring 28, as shown. The actuation axis is oriented along, and takes the form of, the longitudinal axis of the actuator shaft 24.

FIG. 3 shows an exploded view of the low-force shaft seal, which is comprised of an inboard disk 22*a* made of a semi-rigid, lubricious material, such as Fluoropolymer or other suitable semi-rigid, lubricious material either now known or later developed in the future, and an outboard disk 22*b* made of rubber or other suitable elastic material either now known or later developed in the future.

FIG. 4 shows a cross-section of the low-force shaft seal, which has an overlapping configuration as shown that limits contact between the metal actuator shaft 24 and the rubber seal 22*b*. As shown, the overlapping configuration includes disks 22*a*, 22*b* arranged inside the seal cup 26 in relation to, and forming sealing contact with, the actuator shaft 24, and retained in place by the retaining ring 28. The seal cup 26 is arranged inside the housing 25 of the switch base 18 as shown. The disks 22*a*, 22*b* are suitably dimensioned to flex in relation to the actuation shaft 24 to provide the low-force shaft sealing. Embodiments are envisioned using different types of dimensioning to achieve the desired flexing, and the scope of the invention is not intended to be limited to any particular dimensioning to achieve the same. This overlapping configuration maintains a watertight seal, but reduces rotational force from the seal on the actuator shaft 24.

FIG. 5 shows the switch assembly 12 having a base 13 with one or more projections 12*a* extending outwardly from opposing side walls 13*a* that is detached from the mounting plate 14 having a recessed portion 15 with one or more corresponding projections extending inwardly from opposing side walls 15*a* when the base 15 of the switch assembly 12 is arranged in the recessed portion 15 of the mounting plate 14. In operation, the switch assembly 12 and the mounting plate 14 are coupled together by applying a suitable force to, and snapping the one or more projections 12*a* over and into the one or more corresponding projections 14*a* for frictionally engaging the same. In order to remove the switch assembly 12 from the mounting plate 14, a corresponding suitable force is applied. The detachable mounting plate 14 also has one or more release levers 14*b* for gripping the mounting plate 14.

The detachable mounting plate 14 may be affixed to a surface by one or more screws 40, 42.

The detachable mounting plate 14 allows the use of a standardized switch module in all models of a product line. It also allows a wide variety of mounting options.

The scope of the invention is intended to include embodiments utilizing one release lever or even no release levers. For example, embodiments are envisioned in which the switch housing is pushed to one side and tilted out the opposite side of the base.

The Cantilevered Test Lever

FIG. 6 shows another improvement of the present invention in the form of a cantilevered test lever generally indicated as 100, where the mounting base is separate and attached via a snap fit.

The switch embodiment shown in FIG. 6 also includes a cover 102 for protecting a switch paddle 110. The cover 102 makes testing the switch difficult. As shown, the cantilevered test lever 100 may be pressed downwardly to test the switch paddle 110.

Known devices in the prior art focuses on side-mounted knobs to rotate the switch float that is otherwise shrouded by a float guard. The cantilevered test lever 100 shown here is more convenient and robust than existing solutions.

The Scope of the Invention

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

We claim:

1. A float level switch comprising:

a housing;

an actuator shaft arranged in the housing; and a low force shaft seal assembly arranged between the actuator shaft and the housing, having a combination of disks or seals, one being made of a semi-rigid lubricious material, for maintaining a watertight seal with a substantially reduced rotational force or friction on the actuator shaft than a conventional O-ring, wherein the low force shaft seal assembly comprises:

a seal cup coupled to the housing;

an inboard disk or seal arranged between the seal cup and the actuator shaft and being made of the semi-rigid lubricious material;

an outboard disk or seal coupled between the inboard disk or seal and the actuator shaft and being made of rubber; and a retaining ring arranged between the outboard disk or seal and the seal cup for frictionally engaging the outboard disk or seal and holding it in place.

2. A float level switch according to claim 1, wherein the one disk or seal is made of a fluoropolymer (i.e. Teflon) or other suitable semi-rigid lubricious material.

3. A float level switch according to claim 1, wherein the actuator shaft is coupled to a buoyant paddle that is allowed to raise and lower by pivoting about an actuator axis.

4. A float level switch according to claim 3, wherein the float level switch comprises a cover arranged thereon for protecting the buoyant paddle, and a cantilevered test lever coupled to the buoyant paddle for testing the float level switch when the cover is arranged thereon.

5. A float level switch comprising:

a switch assembly having a base with one or more projections extending outwardly from opposing side walls; and a detachable mounting plate having a recessed portion with one or more corresponding projections extending inwardly from opposing side walls for receiving the projections of the switch assembly for frictionally engaging and detachably coupling the switch assembly to the detachable mounting plate when the base of the switch assembly is arranged in the recessed portion of the detachable mounting plate so as to be able to detach the switch assembly from the detachable mounting plate by applying a suitable force to the switch assembly.

6. A float level switch according to claim 5, wherein the mounting plate has one or more release levers.

* * * * *